United States Patent [19]

Lunt

[11] Patent Number: 4,608,719

[45] Date of Patent: Sep. 2, 1986

[54] DISPOSABLE MEDICAL COVER GOWN

[76] Inventor: Audrey T. Lunt, 6371 Vermont Hill Rd., South Wales, N.Y. 14139

[21] Appl. No.: 676,927

[22] Filed: Nov. 30, 1984

[51] Int. Cl.[4] ..... A41B 9/00

[52] U.S. Cl. ..... 2/114; 2/DIG. 7

[58] Field of Search ..... 2/114, DIG. 7, 69.5, 2/74

[56] References Cited

U.S. PATENT DOCUMENTS 3,911,499 10/1975 Benevento et al. ..... 2/114

*Primary Examiner*—Doris L. Troutman

*Attorney, Agent, or Firm*—Michael Ebert

[57] ABSTRACT

A disposable protective gown useable in a medical environment, the gown being fabricated of a single blank of non-woven synthetic fabric sheeting having a generally rectangular form. Cut into the short ends of the blanks in opposing relation are elongated triangular notches whose lower edges extend along an intermediate longitudinal axis which divides the blank into upper and lower sections. The free ends of the lower section are folded in on vertical fold lines to define a pair of rear flaps. The upper section is provided with a central neck opening having a slit therein to admit the head of the wearer, the upper section being folded down along a horizontal fold line extending through the diameter of this opening to define a rear fold. The margin of the rear fold is ultrasonically seamed to the upper edges of the notches to create outstretched sleeves and to the upper edges of the rear flaps to form the rear panel of a gown which can be slipped over the head of the wearer. The unbroken front panel of the gown affords a protective germ barrier, no closures being required to secure the garment to its wearer.

5 Claims, 5 Drawing Figures

Fig. 1.
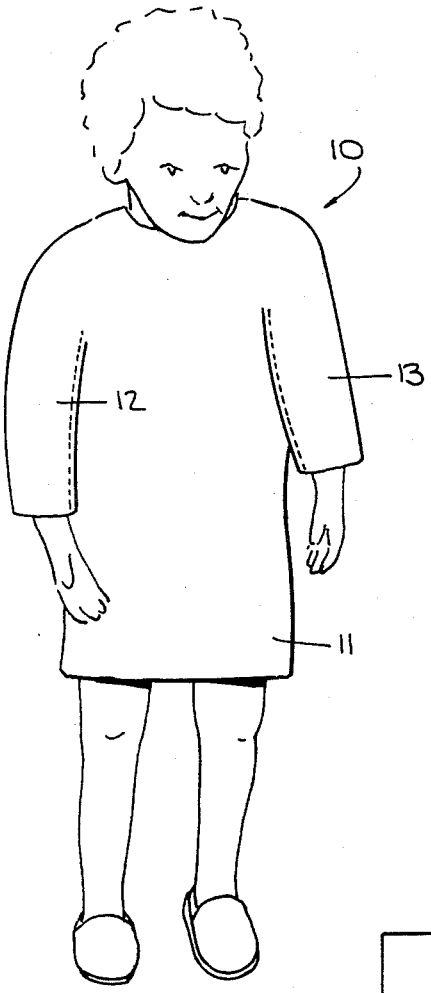
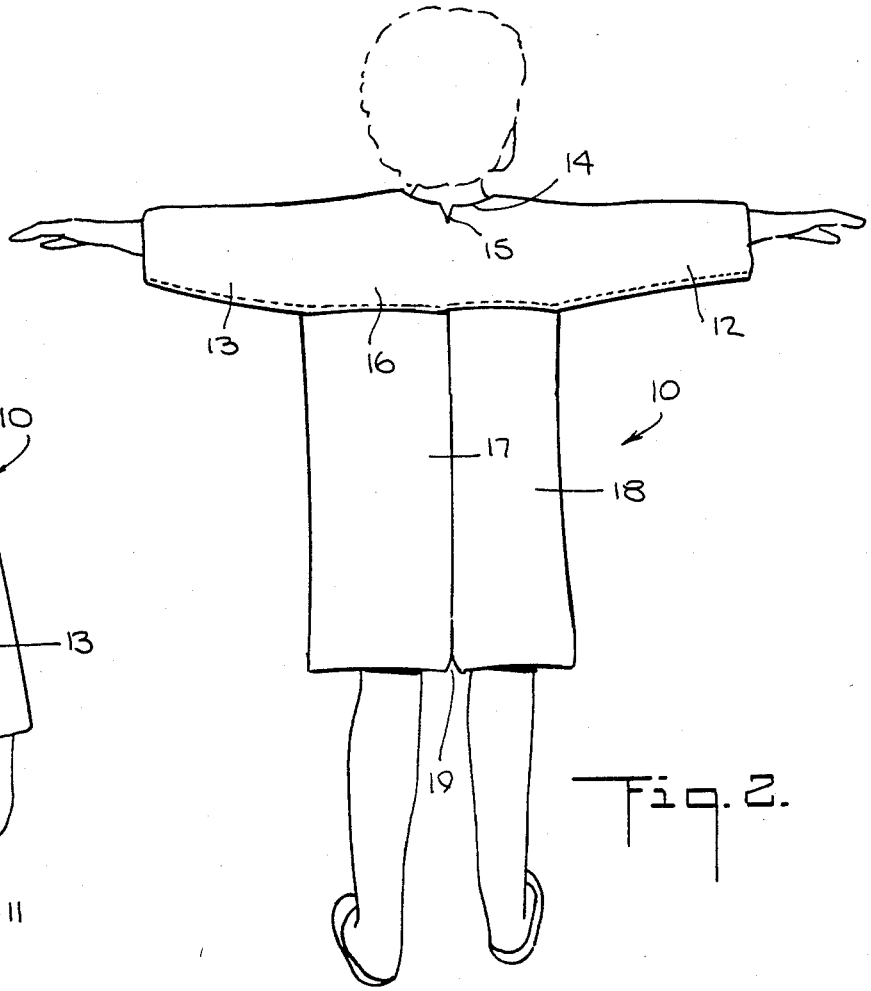
Fig. 2.
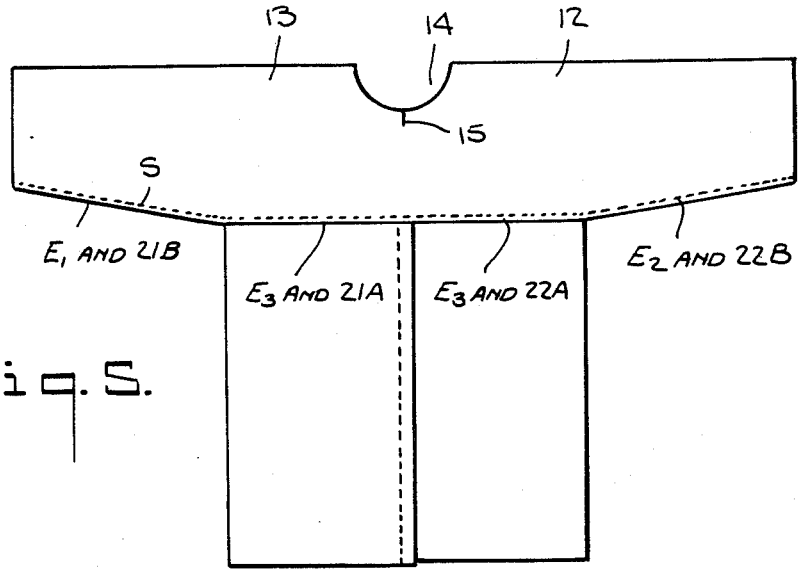
Fig. 5.

Fig. 3.
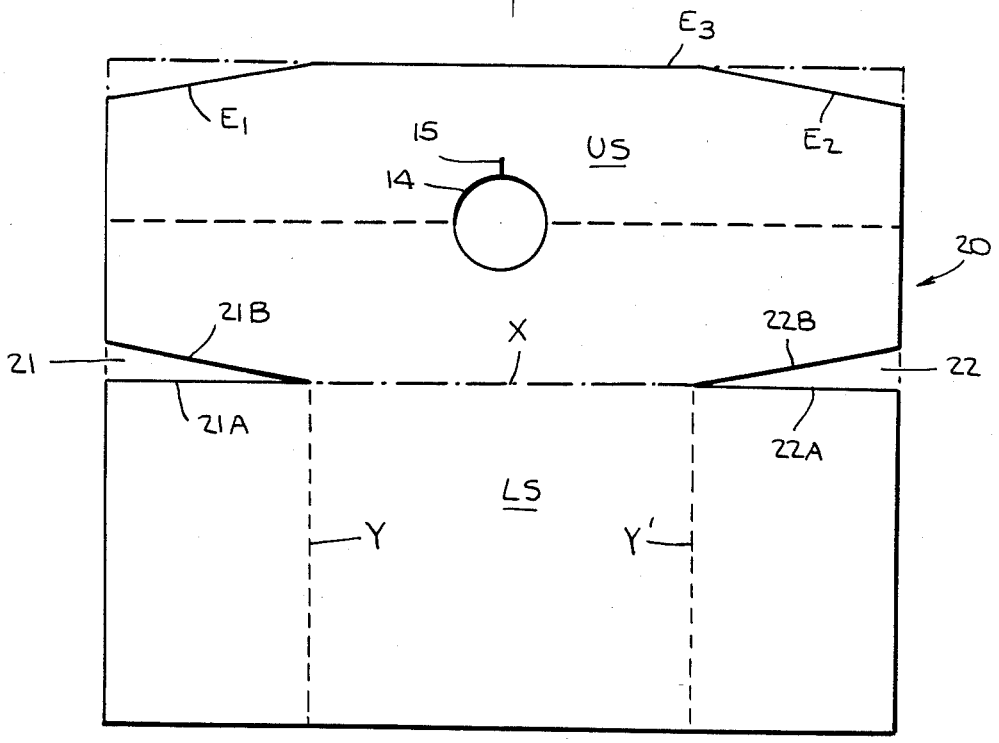
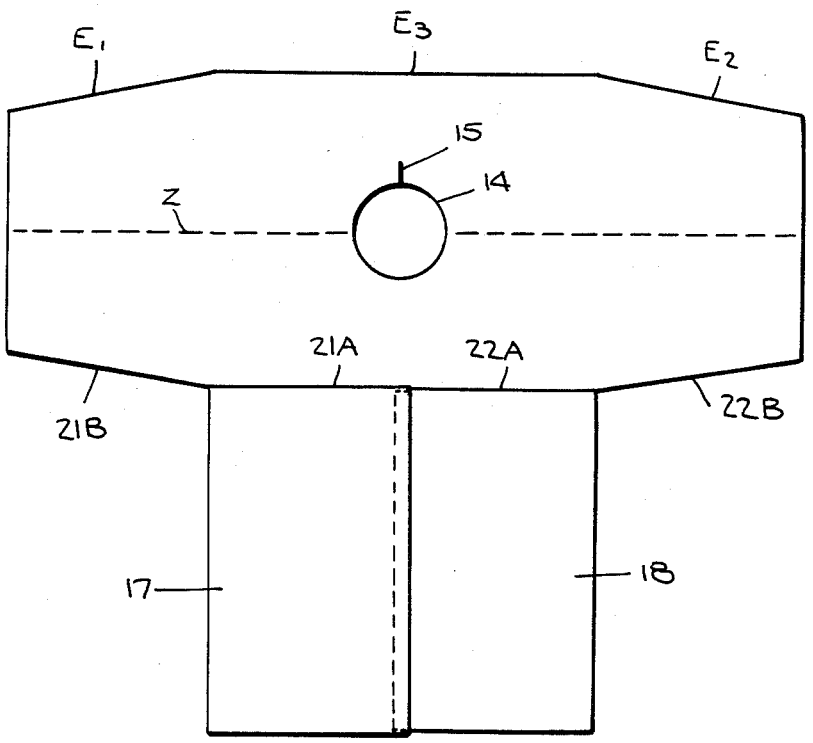
Fig. 4.

DISPOSABLE MEDICAL COVER GOWN

BACKGROUND OF INVENTION

1. Field of Invention

This invention relates generally to protective gowns to be worn in a medical environment such as a hospital, and more particularly to a disposable gown formed of a single blank of non-woven sheeting and adapted to slip over the head of the wearer, no ties or fasteners being required to secure the gown to the wearer.

2. State of Art

In a medical environment such as an operating room or an examination facility, it is common practice for doctors, nurses and other members of the medical staff to wear a protective gown. Most reusable gowns are made from woven natural or synthetic textiles and must be laundered and resterilized after each wearing. Also now available are medical gowns made of non-woven, low-cost fabrics which are discarded after a single use.

But whether the conventional gown is of the woven or non-woven type, its tailoring is generally such as to provide an unbroken front panel and a pair of rear panels. To put on the gown, the wearer, while facing the front panel, inserts his arms through the sleeves and then manipulates ties or other closures to join the rear panels together. The unbroken front panel of the gown affords a germ barrier in the critical area facing the patient.

Thus in the disposable medical gown illustrated in the Benevento et al. U.S. Pat. No. 3,911,499, the gown, which is made from a single blank of non-woven material, includes Velcro fasteners to close the neck flap and to join the back panels together. Should these fasteners not be used, the gown would not remain on the wearer, particularly if he is active. In other commercially-available medical gowns, the closures take the form of ties which require knotting.

The need of protection in a medical environment is by no means limited to staff personnel, for visitors to a medical facility may also require protection. Thus, there is danger of cross-contamination between a patient lying on a hospital bed and a visitor standing close to the bed.

A visitor to a hospital maternity ward is often required to don a protective gown similar to those used by the medical staff. While an adult may not experience much difficulty in putting on a medical gown and in manipulating the rear ties to secure the gown in place, a child required to don a smaller version of this gown may not find it so easy.

Thus, a child visiting a parent or relative who is a patient in a hospital would find it difficult to put on a conventional protective gown; first, because the sleeves are entered into from the front rather than from the rear as in an ordinary garment, and second, because the ties or other closure means are at the rear, not at the front, and cannot be seen as they are being knotted or manipulated. And if the protective gown on the child is not properly closed, it is likely in the case of an active child to fall off the shoulders.

Also of background interest is applicant's prior U.S. Pat. No. 4,382,302 dealing with a medical examination gown provided with Velcro closures.

SUMMARY OF INVENTION

In view of the foregoing, the main object of this invention is to provide a disposable protective gown usable in a medical environment, which gown is free of back ties or other closures, yet remains securely in place regardless of the wearer's activity.

More particularly, an object of the invention is to provide a gown of the above type formed from a single blank of inexpensive non-woven fabric sheeting, the blank being easy to cut out and fabricate.

A salient feature of the invention is that the front of the gown is uninterrupted by seams, cuts or holes and therefore affords an effective barrier against germs, whereas the rear panel of the gown is vented for comfort. A gown in accordance with the invention may be put on simply by slipping it over the head, so that it presents no difficulty, even to a child.

Also an object of the invention is to provide a low-cost disposable gown of non-woven material that requires relatively little seaming to complete, the nature of the blank from which it is made being such as to make optimum use of stock sheeting with minimum waste.

Briefly stated, these objects are attained in a disposable protective gown usable in a medical environment, the gown being fabricated of a single blank of non-woven synthetic fabric sheeting having a generally rectangular form. Cut into the short ends of the blanks in opposing relation are elongated triangular notches whose lower edges extend along an intermediate longitudinal axis which divides the blank into upper and lower sections. The free ends of the lower section are folded in on vertical fold lines to define a pair of rear flaps. The upper section is provided with a central neck opening having a slit therein to admit the head of the wearer, the upper section being folded down along a horizontal fold line extending through the diameter of this opening to define a rear fold. The margin of the rear fold is ultrasonically seamed to the upper edges of the notches to create outstretched sleeves and to the upper edges of the rear flaps to form the rear panel of a gown which can be slipped over the head of the wearer. The unbroken front panel of the gown affords a protective germ barrier, no closures being required to secure the garment to its wearer.

OUTLINE OF DRAWINGS

For a better understanding of the invention as well as other objects and further features thereof, reference is made to the following detailed description to be read in conjunction with the accompanying drawings, wherein:

FIG. 1 is a front perspective view of a child wearing a disposable protective gown in accordance with the invention;

FIG. 2 is a rear view of the gown;

FIG. 3 illustrates the die-cut blank from which the gown is fabricated;

FIG. 4 shows the first step in converting the blank to a gown; and

FIG. 5 shows the second and third steps in this conversion.

DESCRIPTION OF INVENTION

Referring now to FIGS. 1 and 2, there is shown a protective gown 10 dimensioned to be worn by a child whose age may fall in a range from two to about twelve years. It is not necessary to have more than two or three different sizes to cover this range, for the gown is loose fitting and a gown of a given size can be used by children of varying height and girth. It will be appreciated that the invention is not limited to children and that gowns of essentially the same construction may be made in adult sizes.

Gown 10 is fabricated of a non-woven sheeting constituted by randomly-dispersed polyester fibers forming a fabric which satisfies practical as well as medical requirements. Thus, the non-woven material must be reasonably soft and comfortable, flame-retardant, non-toxic and non-allergenic, and have no chemicals added thereto. Suitable for this purpose is the non-woven sheeting marketed by Burlington Industries under the NEXUS trademark. Since the gown is discarded after a single use, the material employed need not to be launderable and therefore may be of low-cost construction.

The gown is composed of a front panel 11, a pair of long sleeves 12 and 13, a neck opening 14 having a slit 15 therein to effectively enlarge the opening in order to acommodate the head of the wearer, a rear shoulder panel 16, and slightly overlapping rear flaps 17 and 18 defining a rear vent 19 which permits expansion of the gown to accommodate the active wearer. The front panel 11 is uninterrupted by seams, cuts or openings, and affords a barrier effective against germs.

As shown in FIG. 3, the gown is fabricated from a single blank 20 of non-woven material having a strictly rectangular form before it is die cut.

The first step in the manufacturing procedure is to die-cut blank 20 to form a pair of elongated, triangular notches 21 and 22 in opposing relation whose lower edges 21A and 22A are colinear and extend along an intermediate logitudinal axis X. This axis effectively divides the blank into an upper section US and a lower section LS. Die-cut into upper section US at its center is the circular neck opening 14 having a slit 15 extending upwardly therefrom to permit entry of the head of the wearer.

The upper corners of upper section US are angle-cut to form sloping upper edges $E_1$ and $E_2$ whose angles complement the upper edges 21B and 22B of the triangular notches. Extending between angled upper corner edges $E_1$ and $E_2$ is a straight center edge $E_3$.

As shown in FIG. 4, the next step is to fold in the free ends of lower section LS along vertical fold lines Y and Y' which run from the apex of the related notch to the lower edge of the blank to form the rear flaps 17 and 18 which preferably overlap slightly. Then as shown in FIG. 5, the upper section US is folded down on a horizontal fold line z which extends through the diameter of neck opening 14, thereby defining the sleeves 12 and 13 and the rear shoulder panel 16 therebetween.

All that is now required to complete the gown is a single seam S which extends along the margin of the rear fold to join the angled corner edges $E_1$ and $E_2$ to the upper notch edges 21B and 22B to complete the sleeves 12 and 13, and to join straight center edge $E_3$ to the upper edges of flaps 17 and 18, thereby forming a protective gown whose rear is vented and whose front is uninterrupted.

Seaming is preferably carried out by ultrasonic welding of the non-woven synthetic plastic material. This is accomplished by placing the plies to be welded together between a "sonotrode" electrode and an anvil, the electrode being vibrated at an ultrasonic frequency to exert an oscillatory force on the plies. This is transformed into heat which softens the plies and causes them to fuse together. No problem is experienced in ultrasonically welding together plies having the same melting point, as is the case here where the plies are derived from a common blank.

While there has been shown and described a preferred embodiment of DISPOSABLE MEDICAL COVER GOWN in accordance with the invention, it will be appreciated that many changes and modifications may be made therein without, however, departing from the essential spirit thereof.

Thus while the disclosed cover gown is in a pull-over style and has no closures, where the user is a trauma patient who has a broken arm or other disability which makes it difficult to don a pull-over gown, then a gown which is open down the back and which can be slipped into is desirable.

To provide a slip-in gown which is open down the entire back, one can use the same blank shown in FIG. 3, except that the short slit 15 in the neck opening 14 is extended to the upper edge $E_3$. Hence when this blank is folded and seamed to form a complete gown as shown in FIG. 2, the rear panels 17 and 18 are then effectively extended up to the neck opening 14 to form an open back, and one can then slip into this gown. But now it is necessary to provide suitable closures. Such closures may take the form of a pair of ties to close the neck, which ties are die cut from the upper section US along parallel lines on either side of the extended slit 15, and a pair of waist ties die cut parallel to the respective short ends of the lower section LS. Or Velcro closures may be used for the same purpose.

I claim:

1. A slip over disposable protective gown usable in a medical environment and requiring no ties or other closures to secure the gown to the wearer, the gown being fabricated of a single blank of fabric sheeting of generally rectangular form having elongated triangular notches in opposing relation cut therein to divide the blank into upper and lower sections, the ends of the lower sections freed by the lower edges of the notches being folded in on vertical fold lines to define a pair of rear flaps, the upper section being provided with a central neck opening having a slit therein to admit the head of the wearer and being folded down along a horizontal fold line extending through the diameter of the opening to define a rear fold whose margin is seamed to the upper edges of the notches to create sleeves and being also seamed to the upper edges of the rear flaps to form a gown having an unbroken shoulder region that can be slipped over the head of the wearer through said neck opening.

2. A gown as set forth in claim 1, wherein said sheeting is formed of non-woven synthetic fibers.

3. A gown as set forth in claim 1, wherein the lower edges of the notches are co-linear and extend along a longitudinal axis.

4. A gown as set forth in claim 3, wherein the corners of the upper section are cut to form edges whose angles complement the angles of the upper edges of the triangular notches.

5. A gown as set forth in claim 2, wherein said seaming is effected by ultrasonic fusion.

* * * * *